US005503477A

United States Patent [19]

Schlough

[11] Patent Number: 5,503,477

[45] Date of Patent: Apr. 2, 1996

[54] SINGLE GUSSETED BAG

[75] Inventor: Debra Schlough, Neenah, Wis.

[73] Assignee: James River Corporation of Virginia, Richmond, Va.

[21] Appl. No.: 117,318

[22] Filed: Sep. 7, 1993

[51] Int. Cl.[6] ..... B65D 30/20; B65D 30/28

[52] U.S. Cl. ..... 383/207; 229/938; 383/120; 383/905; 383/907; 426/115; 426/122

[58] Field of Search ..... 229/938, 87.05, 229/87.08; 383/120, 35, 206, 207, 905, 907; 426/115, 122, 123

[56] References Cited

U.S. PATENT DOCUMENTS

| | | | |
|---|---|---|---|
| 1,827,111 | 10/1931 | Rowe | 383/120 |
| 2,279,327 | 4/1942 | Kehr | 383/120 |
| 2,628,764 | 2/1953 | Rubinstein et al. | 383/120 |
| 3,430,841 | 3/1969 | Kanaga . | |
| 4,608,259 | 8/1986 | Cortopassi . | |
| 4,777,054 | 10/1988 | Greenhouse | 229/938 |
| 5,094,863 | 3/1992 | Vandenburg . | |
| 5,128,182 | 7/1992 | Bunker et al. . | |
| 5,335,996 | 8/1994 | Cortopassi et al. | 383/120 |

*Primary Examiner*—Stephen P. Garbe
*Attorney, Agent, or Firm*—Sixbey, Friedman, Leedom & Ferguson

[57] ABSTRACT

An elongated serving, storing and heating bag for a food product of the type having a folded shell construction such as a taco, burrito, hot dog or the like is disclosed. The bag is in the form of an open ended bag of paper-like material having a dead fold capability with the bag including first and second side panels hingedly connected to one another along substantially parallel first and second fold lines with the first and second side panels combining to form an elongated tubular sleeve having a first open end and a second sealed end for receiving the food product therein. The bag further includes a gusseted fold line forming one of the first or second fold lines so as to permit expansion of the bag along one longitudinal edge. A line of weakness in the form of a perforated line or tear strip is formed substantially coextensive with the other of the first or second fold line, such that the gusseted fold line permits expansion of the internal volume of the bag to receive the food product therein while the bag tapers towards the fold line including the line of weakness for maintaining the orientation of the food product within the bag and for allowing easy access to the contents of the bag.

24 Claims, 5 Drawing Sheets

SINGLE GUSSETED BAG

TECHNICAL FIELD OF THE INVENTION

The present invention relates to a bag for accommodating a food product and more particularly to an elongated serving, storage and eating bag for a food product of a type having a folded shell construction such as a taco, hot dog, hoagie, submarine sandwich, gyro, pita pouch and the like.

BACKGROUND OF THE INVENTION

Hot sandwiches are ideal for convenience food in many ways, they can be quickly prepared, quickly consumed, and generally no utensils are necessary for their consumption. However, the perfect convenience food must be capable of being prepared before it is needed, stored and then served almost immediately after the consumer places an order. In this respect, hot food items such as tacos, hot dogs and other elongated food items which require a folded shell fall short of being a perfect convenience food in that it is difficult to provide a suitable but inexpensive package for storing, serving and consuming such articles. Further, it is often necessary to support the elongated food item in an upright position in order to prevent the contents thereof from being displaced from their shell.

One attempt in overcoming such shortcomings is set forth in U.S. Pat. No. 4,608,259 issued to Cortopassi wherein a pocket wrap is disclosed for wrapping about an elongated food product such as a taco, burrito, or hot dog. With the pocket wrap disclosed therein, a sheet of wrapping material is formed into an envelope having an elongated open edge and open end with the food product being placed within the envelope. Subsequently, the opened end of the pocket is folded inwardly and an overwrap is folded over the food product to close the elongated side of the envelope. However, with such a construction due to the expandability of the food product and the lack of retaining pressure along the upper elongated length of the envelope, the envelope may readily open thus exposing the contents of the envelope due to the lack of support of the food product placed therein. Moreover, because this envelope requires an overwrap, essentially three side panels need be present which results in a significant waste of wrapping material versus a bag which requires only two panels.

A tri-cornered bag disclosed in U.S. Pat. No. 3,430,841 issued to Kanaga is formed of a paper stock material having a closed end and an open end for receiving an elongated type food product. However, consumption of the elongated food product is made difficult in that the food product must be removed from the open end of the tri-cornered bag. Further, because the closed end of the tri-cornered bag is in the form of a triangle, the bag does not exert a significant restraining force on the food product placed within the bag.

U.S. Pat. No. 5,094,863 issued to Vandenburg [sic, Vandenberg] and assigned to the assignee of the subject invention, the contents of which are hereby incorporated herein by reference, discloses a bag which is formed from a three layer composite wrap material. The bag includes front and back panels which are hingedly connected to one another by way of gusseted side panels along both longitudinally extending sides of the bag. In order to gain access to the contents of the bag, a rip cord or tear strip is provided which traverses laterally across the longitudinal length of the bag. Again, while this bag does in fact form a receptacle for a food product which provides a convenient means for consuming the food product while maintaining the food product in a partially wrapped condition to prevent cooling of the product and soiling of the hands of the consumer, this bag does not provide sufficient lateral support to an elongated food product such as a taco, hot dog or the like.

Similarly, U.S. patent application Ser. No. 909,172 filed Jul. 6, 1992, now U.S. Pat. No. 5,349,366 and assigned to the assignee of the subject application, the contents of which are incorporated herein by reference discloses in another package for accommodating a food product wherein the package is in the form of a bag having gusseted side panels which permit the bag to expand and receive a food product therein. The bag further includes perforated lines extending along each of the gusseted side panels in order to permit a front or top panel of the bag to be substantially removed to uncover the contents thereof. This is done so as to utilize the food product package itself as a sanitary surface from which to consume the food products. However, again this bag cannot provide sufficient lateral support to an elongated food product which is susceptible to expanding and consequently opening within the bag itself.

Clearly, there is a need for a simple bag construction for accommodating an elongated folded food product which provides lateral support to such food product when placed within the bag to prevent the food product from expanding therein. Moreover, there is a need for a package for accommodating an elongated food product which laterally supports the food product when placed therein and which ready access to the contents of the package may be provided.

SUMMARY OF THE INVENTION

A primary object of the present invention is to overcome the disadvantages and shortcomings associated with the various packages for accommodating a food product set forth hereinabove.

It is a primary object of the present invention to provide a package for accommodating food products such as tacos, burritos, hot dogs and the like which require some expansion due to the thickness of the food product but also require substantial lateral support from the bag so as to maintain the food product in an upright and closed condition.

It is yet another object of the present invention to provide a package for accommodating a food product wherein it is desired to maintain the orientation of the food product within the bag.

A further object of the present invention is to provide a bag for accommodating a food product wherein the contents of the bag are easily accessible by the consumer.

A further object of the present invention is to provide a bag for accommodating a food product wherein the bag is formed of a material having a sufficient dead fold capability so as to maintain the structural integrity of the bag once the food product is placed therein.

Yet another object of the present invention is to provide a package for a food product wherein the package is formed of a laminate material which is relatively impervious to moisture and moisture vapor and which forms an insulated bag for maintaining the food product hot.

These as well as additional objects of the present invention are achieved by providing an elongated serving, storing and heating bag for a food product of the type having a folded shell construction such as a taco, burrito, hot dog or the like. The bag is in the form of an open ended bag of paper-like material having a dead fold capability with the bag including first and second side panels hingedly connected to one another along substantially parallel first and second fold lines with the first and second side panels combining to form an elongated tubular sleeve having a first open end and a second sealed end for receiving the food product therein. The bag further includes a gusseted fold line forming one of the first or second fold lines so as to permit expansion of the bag along one longitudinal edge. The bag further includes a line of weakness in the form of a perforated line or tear strip formed substantially coextensive with the other of the first or second fold line, such that the gusseted fold line permits expansion of the internal volume of the bag to receive the food product therein while the bag tapers towards the fold line including the line of weakness for maintaining the orientation of the food product within the bag and for allowing easy access to the contents of the bag.

The bag formed in accordance with the foregoing is formed of a stock material wherein the stock material is a flexible laminate sheet material including at least one moisture and moisture vapor impervious layer and at least one insulating layer. The stock material may further be in the form of a laminated sheet material including a first layer of absorbent material, a second layer of printable material and an impermeable polymer layer interposed between the first and second layers.

In addition to the foregoing, a bag formed in accordance with the present invention may further include an extension tab which permits ease in opening the open end of the bag for initially passing the food product into the opened bag.

These as well as additional objects of the present invention will become apparent from the following detailed description of the invention when read in light of the several figures.

DETAILED DESCRIPTION OF THE PREFERRED EMBODIMENT

Figure 1:
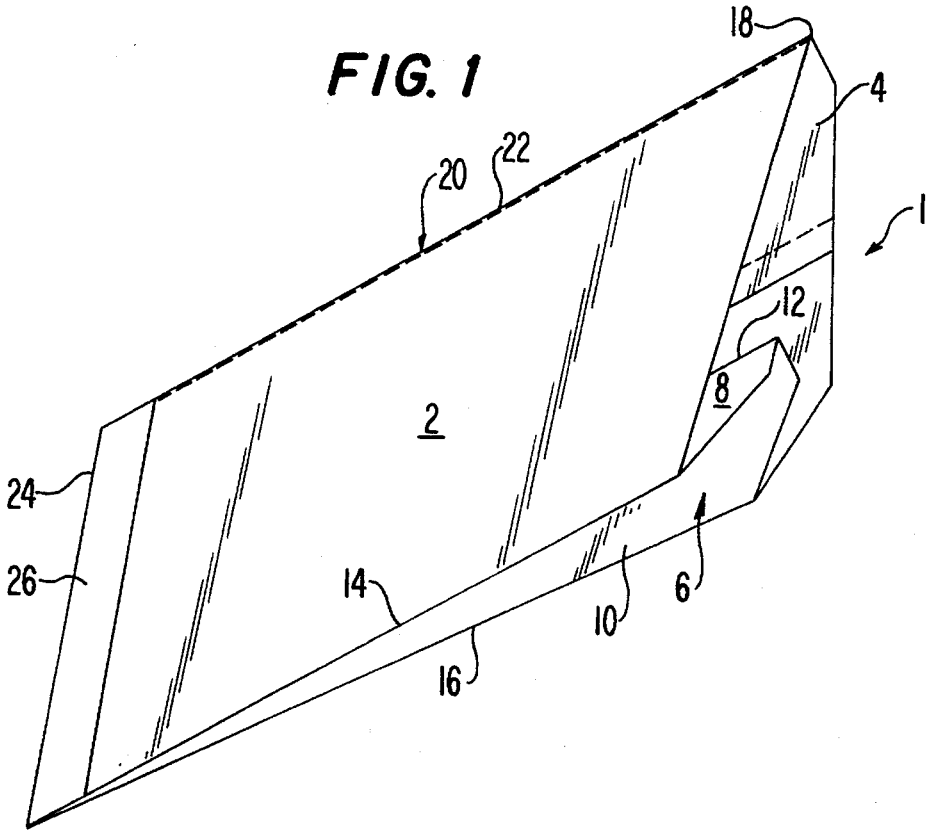
FIG. 1 is a perspective view of a one-sided gusseted bag in a partially opened condition ready to receive a food product therein in accordance with the present invention.

Referring now to the several figures and particularly FIG. 1, the preferred embodiment of the present invention will be described in detail. As can be seen from FIG. 1, the bag I in accordance with the present invention includes a front or first side panel 2 and a rear or second side panel 4 with the front and rear panels being connected to one another in order to form an elongated tubular sleeve. Formed between the front panel 2 and the rear panel 4 is a gusseted section 6 which permits the lower portion of the bag to expand upon insertion of a food product therein. The gusseted section includes a first panel 8 and a second panel 10 which are hingedly connected to one another along fold line 12. The first panel 8 is hingedly connected to the front panel 2 along fold line 14 which extends substantially the entire length of the bag 1. Similarly, the second panel 10 is hingedly connected to the rear panel 4 along longitudinal fold line 16. As will become readily apparent from the ongoing discussion, the fold lines 12, 14 and 16 as well as first panel 8 and second panel 10 cooperate to permit the bag to be opened and consequently expand the volume of the bag in a manner which tapers upwardly towards an apex 18 of the bag.

The apex 18 of the bag is in fact an elongated longitudinal fold line 20 which extends along the length of the bag 1 and hingedly connects the front panel 2 to the rear panel 4. In accordance with a preferred embodiment of the present invention, a perforated cut score line or line of weakness 22 is coextensively formed along the fold line 20.

In order for the tubular sleeve to receive and maintain the food product therein, the end 24 of the bag is closed. This may be carried out by various means including overfolding the elongated sleeve and sealing the overfold 26 to the front panel 2 or rear panel 4 of the bag. This seal may also be accomplished by heat sealing the inner surfaces of the front panel 2 and rear panel 4 to one another depending upon the particular material from which the bag 1 is manufactured.

Referring to materials from which the bag 1 may be manufactured, U.S. Pat. No. 5,128,182 issued to Bunker et al. and assigned to the assignee of the subject application, the contents of which are hereby incorporated by reference discloses one such material which may be used in manufacturing bags in accordance with the present invention. Specifically, a composite integral sheet material which includes a fast layer of absorbent material, a second layer of printable material and an impermeable pigmented polymer layer interposed between the first and second layers is set forth therein. The composite material includes a plurality of air pockets formed between at least one of the first and second layers and the polymer layer by discontinuously bonding the first and/or second layers to the polymer material. A material similar to that discussed hereinabove is set forth in U.S. patent application Ser. No. 714,928 filed Jun. 13, 1991 now abandoned in the name of Patterson et al. and assigned to the assignee of the subject invention, the contents of which are hereby incorporated by reference. The composite material set forth therein includes a first layer of absorbent material containing fibers bearing foraminous hydrophobic water-vapor-permeable pellicles, a second layer of printable material and an impermeable pigmented polymer layer interposed between the first and second layers. The absorbent layer may include highly absorbent material formed by in-situ crosslinking of a partially pre-neutralized polyacrylic acid. As with the above mentioned material, this material also has a plurality of air pockets formed between at least one of the first and second layers and the polymer layers by discontinuously bonding the first and/or second layers to the polymer layer.

Figure 2:
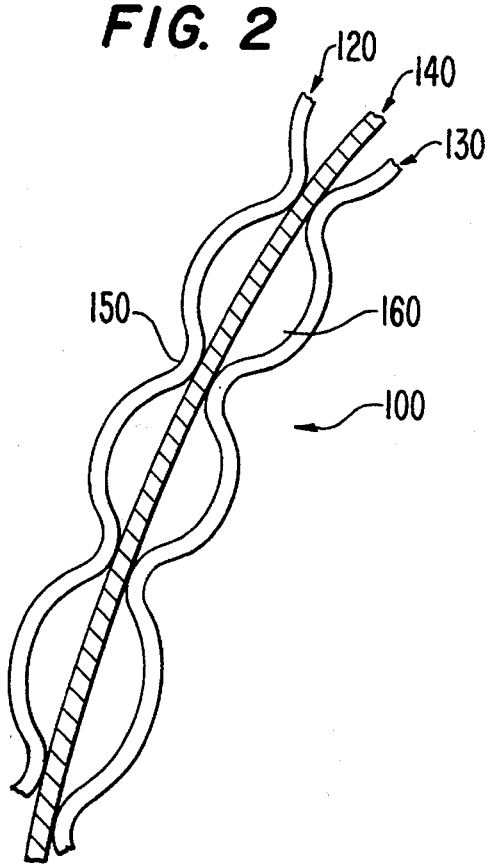
FIG. 2 is an exploded partial cross-sectional view of the stock material from which the bag illustrated in FIG. 1 may be manufactured.

One laminate material which is particularly suited for use in manufacturing the bags in accordance with the present invention is that which is marketed under the tradename QUILT-RAP™ which is essentially that material set forth in above noted U.S. Pat. No. 5,128,182. Such a composite material which is illustrated in FIG. 2 is generally a three ply composite wrap material. The material 100 is made of a first absorbent layer 120, a second printable layer 130 and an impermeable polymer layer 140 interposed between the first and second layers. The first and second layers are discontinuously or spot bonded in the areas 150 to the respective opposite sides of the layer 140 which is interposed therebetween thereby forming air pockets 160. In use, one side of the absorbent layer 120 is placed adjacent to the food product placed within the bag. On the other side of the absorbent layer 120 is the impermeable polymer layer 140. The layer 120 absorbs water vapor from the food product which has passed through it and has condensed on the impermeable polymer layer 140 as well as any grease which may be present within the bag. As discussed hereinabove, the material must also have a sufficient dead fold capability in order to retain the preferred fold lines of the bag, accordingly, the absorbent layer preferably has a basis weight ranging from 5 to 50 pounds per 3,000 square feet and more preferably ranging from 10 to 20 pounds per 3,000 square feet. Further, the basis weight of the absorbent layer 120 must be such that it can absorb all of the water vapor lost by the food product and condensed on the impermeable layer 140. The materials which achieve such basis weight are preferably selected from a group of materials consisting of but not limited to non-woven tissue, air laid fabric, wet laid tissue, wet or dry creped tissue and embossed papers.

Additionally, the printable layer 130 which is positioned adjacent to the side of the impermeable polymer layer 140 away from the food product, may be used for printing of identifying symbols, marks, labels or other indicia of the source of the food products. The printable layer 130 also preferably has a good dead fold capability with a basis weight ranging from 10 to 50 pounds per 3,000 square feet, and more preferably ranging from 10 to 25 pounds per 3,000 square feet. This printable layer 130 may be any material having a printable surface such as a coated paper. Typically, one surface of the printable paper 130 has a smoother surface and materials capable of use as the printable layer 130 may be selected from the group of materials consisting of machine glazed papers and various coated papers.

Figure 3:
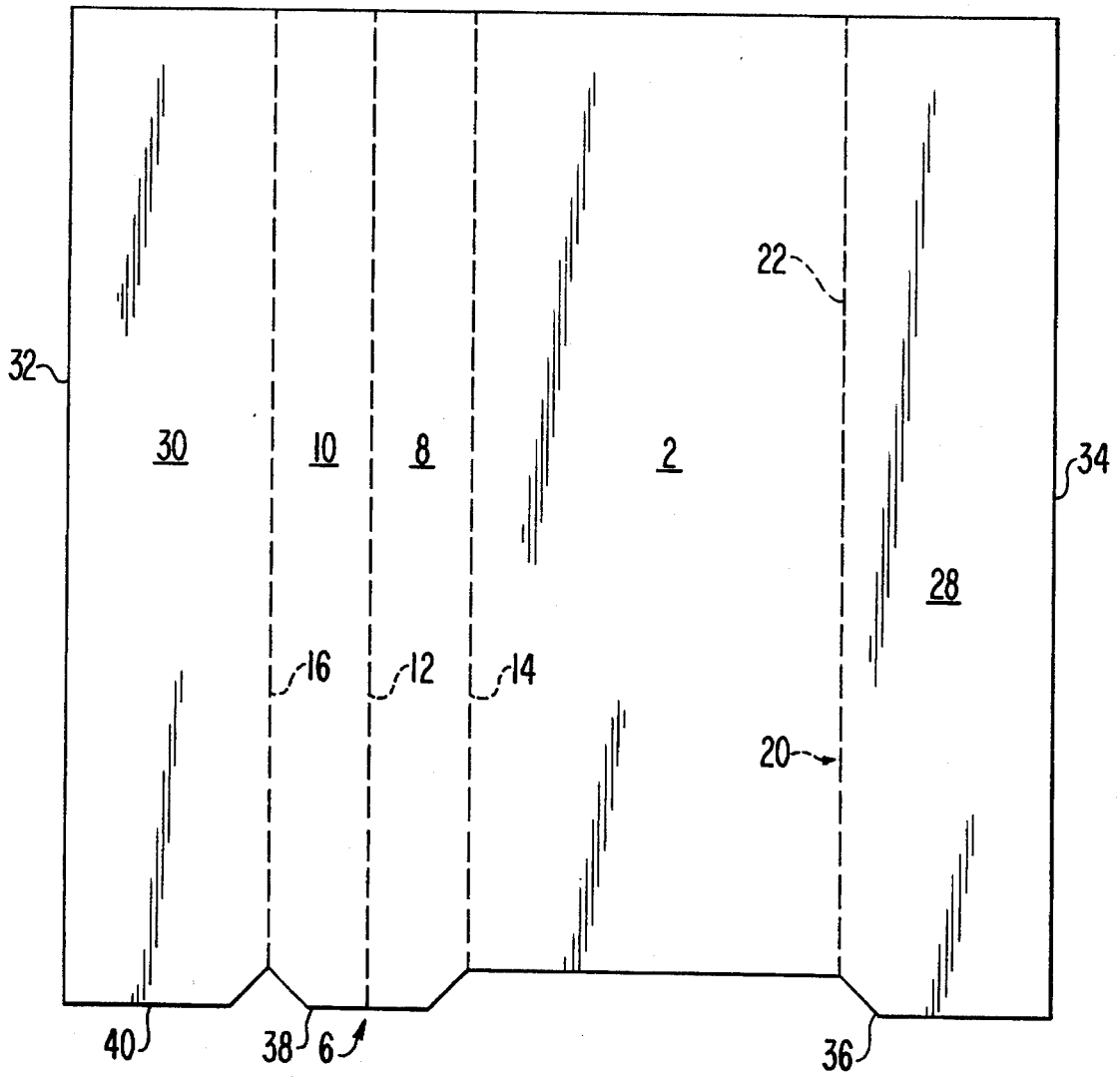
FIG. 3 is a plainer view of the gusseted bag in its unfolded and unsealed condition.

Referring now to FIG. 3, wherein the bag in accordance with the present invention is illustrated in its unfolded and unsealed condition. As can be seen from FIG. 3, the bag includes front panel 2 which is hingedly connected to a first portion 28 of the rear panel 4 along fold line 20. As mentioned hereinabove, this fold line 20 includes a coextensive perforated line 22 in accordance with a preferred embodiment of the present invention, the significance of which will be discussed in greater detail hereinbelow. Also, hingedly connected to the front panel 2 along fold line 14 is first panel 8 with second panel 10 being hingedly connected to first panel 8 along crease score fold line 12. As discussed hereinabove, the first panel 8 and second panel 10 combine with one another in order to form the gusset section 6. Similarly, hingedly connected to the second panel 10 along crease score fold line 16 is a second portion 30 of the rear panel 4.

In order to form the bag in accordance with the present invention from the unfolded bag illustrated in FIG. 3, the first portion 28 is folded along crease score line 20 such that an inner surface of the first portion 28 is substantially in contact with the inner surface of the front panel 2. Likewise, the gusset 6 is formed by folding the first panel 8 along crease score fold line 14 such that the inner surface of the first panel is substantially in contact with an inner surface of the front panel 2 with the second panel 10 subsequently being back folded along crease score line 12 such that the outside surface of the second panel 10 is substantially in contact with the outside surface of the first panel 8. Subsequently, the second portion 30 of the front panel 4 is folded inwardly such that the inside surface of the second portion 30 substantially contacts the inside surface of the second panel 10 and a portion of the front panel 2. In doing so, the longitudinally extending edge 32 of the second portion 30 will overlap the longitudinally extending edge 34 of the first portion 28 with the sealing seam being formed between the first portion 28 and second portion 30 in order to form the rear panel 4. This sealing of the seam may be carded out in any manner suitable for forming such bags and is depended upon the material from which the bag is made. Types of seals may include but are not limited to heat sealing the materials to one another, providing a cold forming adhesive between portions 28 ad 30 or use of a hot melt adhesive. It should be appreciated by those skilled in the art that the perforation 22 may be formed prior to the folding of the bag into a sleeve or thereafter.

Once a tubular sleeve is formed from the blank, one end of the tubular sleeve may be readily overfolded and sealed or heat sealed there along the end in order to close that respective end of the tubular sleeve. It should be noted from FIG. 3 that the bag formed in accordance with the present invention include tabs 36, 38 and 40 which cooperate to form a means for readily opening the open end of the bag in order to receive a food product therein. This feature may be readily apparent from FIG. 4A which illustrates the tab portions 36, 38 and 40 cooperating to form tab 42 of the bag.

Figure 4A:
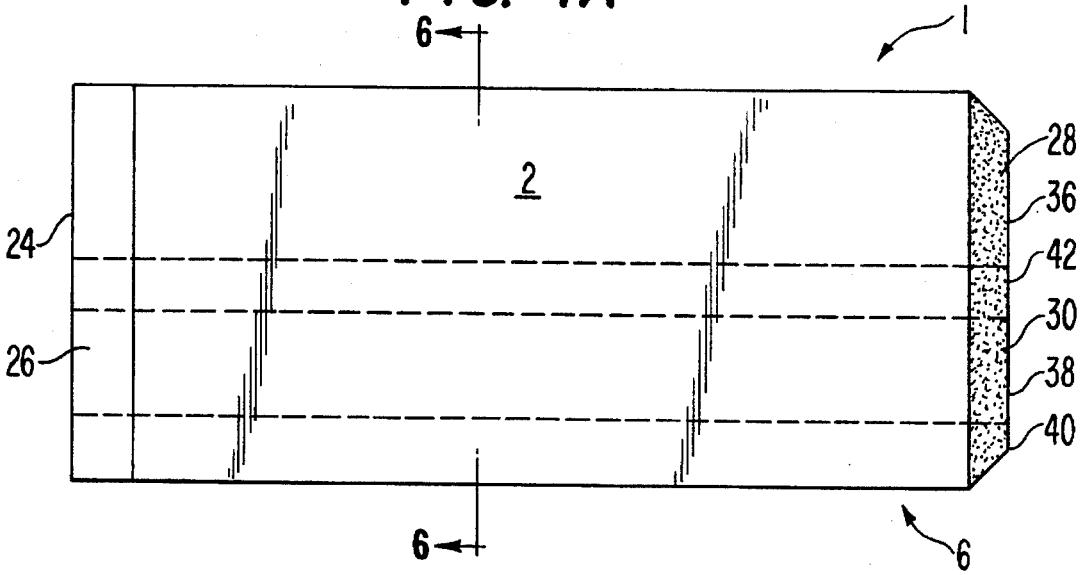
FIG. 4A is an elevated front view of the bag formed in accordance with the present invention.

As is further illustrated in FIG. 4A, the longitudinally extending seam between the first portion 28 and the second portion 30 of the rear panel 4 extends substantially the entire length of the bag 1. Also, it is readily apparent that the gusset 6 also extends along the entire length of the bag.

Figure 5:
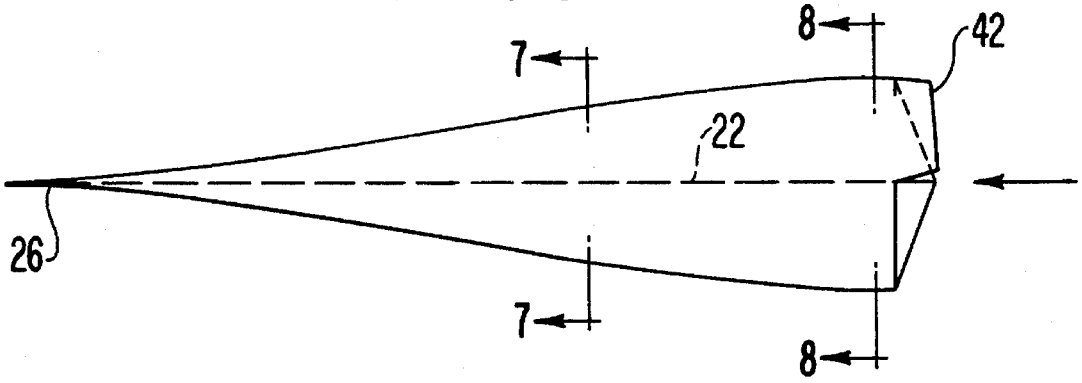
FIG. 5 is a top view of the bag formed in accordance with the present invention in the opened condition.

Referring now to FIG. 5, it can be seen that because of the pinch seal or overfold at the closed end of the bag, the bag opens in a manner such that the product may be placed therein and retained in an upright position due to the tapering of the bag itself as well as by the pinched or overfolded end 26.

Figure 6:
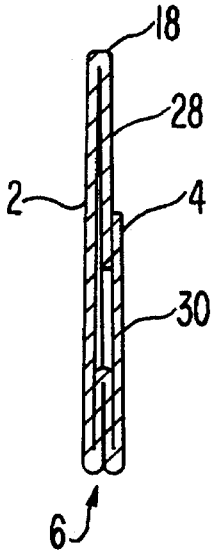
FIG. 6 is a cross-sectional view taken along line 6—6 of FIG. 4A illustrating the bag in a collapsed condition.
Figure 7:
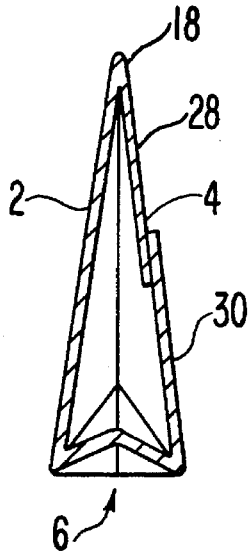
FIG. 7 is a cross-sectional view of the bag taken along line 7—7 of FIG. 5.
Figure 8:
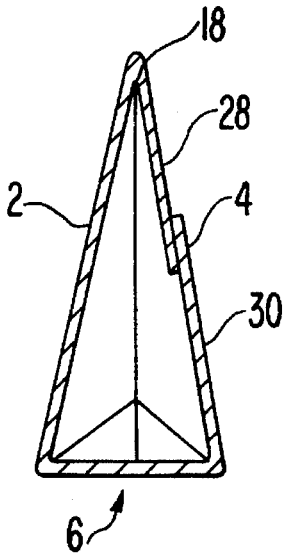
FIG. 8 is a cross-sectional view of the bag taken along line 8—8 of FIG. 5 and illustrating the bag in its fully expanded condition.

With reference to FIG. 6, the bag is initially in the unexpanded and folded condition wherein the inner surfaces of the front panel 2 and rear panel 4 are substantially in contact with one another. As can be seen from FIG. 6, the gusset section 6 is received within the interior of the bag when the flap end is unexpanded. Continuing to FIG. 7, the bag illustrated therein is in the partially expanded condition wherein the bottom portion of the bag is expanded by way of the gusset 6 while the top portion of the bag is in the form of an apex of a triangle which will maintain the contents of the bag in an upright position. Still further expansion of the bag results in the configuration illustrated in FIG. 8 wherein the lower portion of the bag is completely expanded in order to receive a food product therein while an upper portion of the bag remains tapered such that an elongated food product placed within the bag is maintained in an upright position. Consequently, the lack of slack at the upper portion of the bag prevents any rollover of the food product inside the bag. Accordingly, the contents of a taco or the condiments placed on a hot dog remain in their desired position. Additionally, the tab 42 formed along the open end of the bag allows the food product to be readily inserted into the bag. The leading edge of the food product may be pressed against the tab 42 which separates the rear panel 4 from the front panel 2 in order to allow the product to pass into the bag. Also, the bag may be preopened prior to insertion of the food product therein by grasping the tab 42 and separating the rear panel 4 from the front panel 2 of the bag.

Figure 4B:
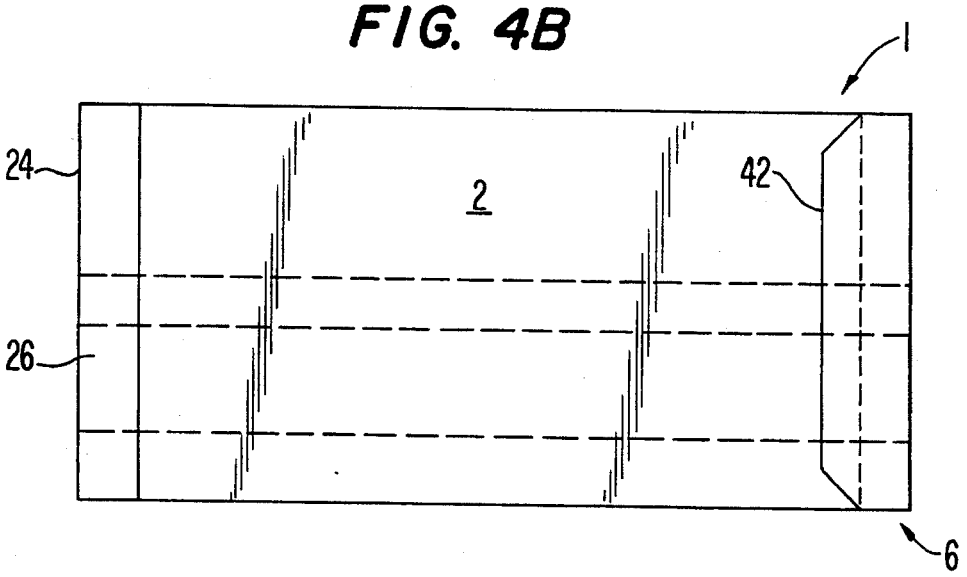
FIG. 4B is an elevated front view of the bag as illustrated in FIG. 4A in the closed condition.

Once the product is placed in the bag, the front end of the bag may be overfolded in order to partially seal the front opening of the bag and maintain an elevated temperature within the bag. In order for this to be accomplished, a pressure sensitive adhesive or other type adhesive may be placed on the inner surface of the tab 42 as illustrated in FIG. 4A. Accordingly, the tab 42 may be overfolded and adhered to an outer surface of the front panel 2. Alternatively, a portion of the bag may also be overfolded as illustrated in FIG. 4B. When the food product within the bag is to be consumed, the front end may be opened and the food product exposed from the end of the bag for consumption. Preferably, the bag may be separated along the upper fold line 20 by way of the perforated line 22 in order to readily gain access to the entire product within the bag.

Figure 9:
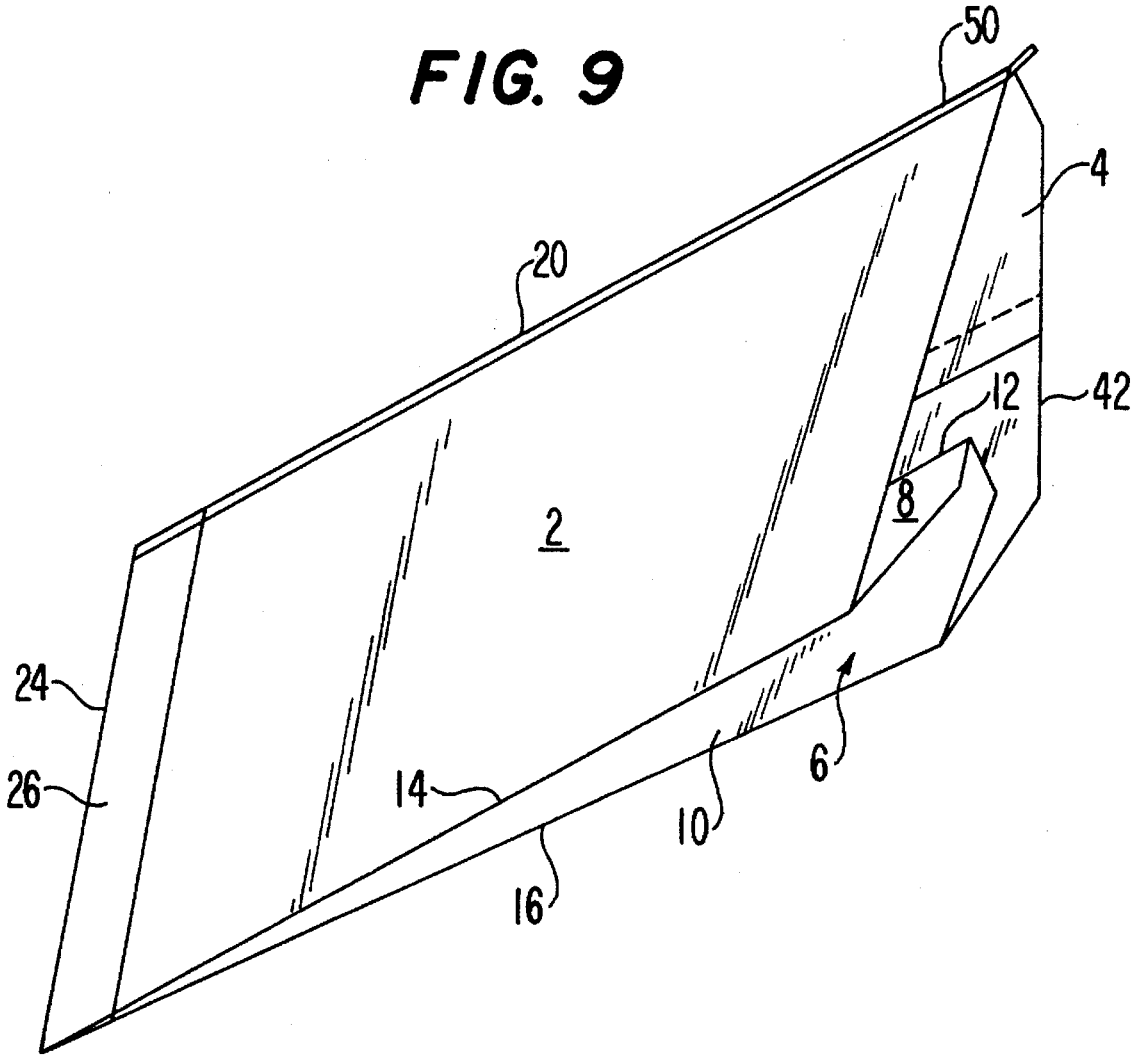
FIG. 9 is a perspective view of the bag formed in accordance with an alternative embodiment of the present invention and including a tear strip formed therein.

Alternatively, with the embodiment illustrated in FIG. 9, a tear strip or rip cord 50 is provided substantially coextensive with the fold line 20. This rip cord acts substantially the same as the perforated fine 22 in opening the entire bag along the upper apex thereof. The remaining construction of the bag is substantially identical to that illustrated in FIG. 1 including a front panel 2, rear panel 4, gusset 6 and the extension 42.

Accordingly, with the bag manufactured in accordance with the present invention, elongated food products such as tacos, hot dogs and the like may be readily inserted into the open end of the bag and maintain in an upright orientation due to the triangular shape of the bag. Further, due to the insulated nature of the bag, the contents thereof can be maintained hot or cold for an extended period of time. Additionally, with the perforated line 22 or the tear strip 50 formed in the upper apex of the bag, the bag may be readily opened for access to the entire food product by the consumer.

While the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. An elongated serving, storing and eating bag for a food product of the type having a folded shell construction, said bag comprising:

a first side panel;

a second side panel hingedly connected to said first side panel along a fold line along a first edge thereof and an expansion means along a second edge thereof for permitting expansion of an internal volume of the bag, said first and second side panels combining to form an elongated tubular sleeve having a first open end and a second sealed end for receiving the food product therein; and access means formed substantially coextensive with said fold line for permitting access to contents placed within the bag;

wherein said expansion means is formed substantially parallel to said fold line to permit expansion of the internal volume of the bag to receive the food product therein while maintaining a constricting region within the bag.

2. The bag as defined in claim 1, wherein said access means is a line of weakness extending along substantially an entire length of said fold line.

3. The bag as defined in claim 2, wherein said line of weakness is a perforated cut score line which permits the first and second side panels of the bag to be separated along said fold line.

4. The bag as defined in claim 2, wherein said line of weakness is a tear strip which permits the first and second side panels of the bag to be separated along said fold line.

5. The bag as defined in claim 1, wherein the bag is formed of a stock product having a dead fold capability.

6. The bag as defined in claim 5, wherein said stock material is a flexible laminate sheet material.

7. The bag as defined in claim 6, wherein said laminate sheet material includes at least one moisture and moisture vapor impervious layer.

8. The bag as defined in claim 7, wherein at least one layer of said laminate sheet material is an insulating layer.

9. The bag as defined in claim 6, wherein at least one layer of said laminate sheet material is discontinuously bonded to a surface of an adjacent layer of said laminate at spaced locations such that air pockets are formed by the bond locations and between said at least one layer and said adjacent layer.

10. The bag as defined in claim 5, wherein said laminate sheet material includes a first layer of absorbent material, a second layer of printable material and an impermeable polymer layer interposed between said first and second layers.

11. The bag as defined in claim 10, wherein said polymer layer is a pigmented polymer layer.

12. The bag as defined in claim 1, wherein said sealed end of said tubular sleeve includes an over fold with said over fold being adhered to an external surface of one of said first and second side panels.

13. An elongated serving, storing and eating bag for a food product of the type having a folded shell construction, said bag comprising:

a first side panel;

a second side panel hingedly connected to said first side panel along a fold line and a gusseted fold line substantially parallel to said fold line, said first and second side panels combining to form an elongated tubular sleeve having a first open end and a second sealed end for receiving the food product therein; and a line of weakness formed coextensive with said fold line;

wherein said gusseted fold line permits expansion of the internal volume of the bag to receive the food product therein.

14. The bag as defined in claim 13, wherein said line of weakness is a perforated cut score line which permits the first and second side panels of the bag to be separated along said fold line.

15. The bag as defined in claim 13, wherein said line of weakness is a tear strip which permits the first and second side panels of the bag to be separated along said fold line.

16. The bag as defined in claim 13, wherein the bag is formed of a stock material having a dead fold capability.

17. The bag as defined in claim 16, wherein said stock material is a flexible laminate sheet material.

18. The bag as defined in claim 17, wherein said laminate sheet material includes at least one moisture and moisture vapor impervious layer.

19. The bag as defined in claim 18, wherein at least one layer of said laminate sheet material is an insulating layer.

20. The bag as defined in claim 17, wherein at least one layer of said laminate sheet material is discontinuously bonded to a surface of an adjacent layer of said laminate at spaced locations such that air pockets are formed by the bond locations and between said at least one layer and said adjacent layer.

21. The bag as defined in claim 17, wherein said laminate sheet material includes a first layer of absorbent material, a second layer of printable material and an impermeable polymer layer interposed between said first and second layers.

22. The bag as defined in claim 21, wherein said polymer layer is a pigmented polymer layer.

23. The bag as defined in claim 13, wherein said closed end of said tubular sleeve includes an over fold with said over fold being adhered to an external surface of one of said first and second side panels.

24. An elongated serving, storage and eating bag for a food product having a folded shell construction, said bag comprising:

an elongated tubular sleeve having an open end and a sealed end;

at least one perforated fold line extending longitudinally from said open end to said sealed end; and at least one gusseted fold section extending substantially parallel to said perforated fold line;

wherein said sleeve is formed of a material having a predetermined dead fold capability.

* * * * *